US007301290B1

(12) United States Patent
Tseng

(10) Patent No.: US 7,301,290 B1
(45) Date of Patent: Nov. 27, 2007

(54) BRIGHTNESS CONTROL DEVICE OF LIGHT BULB MODULE

(76) Inventor: Ming-Chi Tseng, No. 18, Jhensing E. St., Wufong Township, Taichung County 413 (TW)

( * ) Notice: Subject to any disclaimer, the term of this patent is extended or adjusted under 35 U.S.C. 154(b) by 0 days.

(21) Appl. No.: 11/709,656

(22) Filed: Feb. 23, 2007

(51) Int. Cl.
*H05B 37/02* (2006.01)

(52) U.S. Cl. ..... 315/299; 315/307

(58) Field of Classification Search ..... 315/246, 315/250, 291, 294, 299, 307, 361
See application file for complete search history.

(56) References Cited

U.S. PATENT DOCUMENTS 4,189,664 A * 2/1980 Hirschfeld ..... 315/297
4,350,935 A * 9/1982 Spira et al. ..... 315/291
6,384,545 B1 * 5/2002 Lau ..... 315/292

* cited by examiner

*Primary Examiner*—Thuy Vinh Tran
(74) *Attorney, Agent, or Firm*—Rosenberg, Klein & Lee

(57) ABSTRACT

A brightness control device for a light bulb module utilizes a microcontroller equipped with a first control circuit, a second control circuit, a third control circuit, and a fourth control circuit to maintain an even luminance of each light bulb in the light bulb module of a lighting fixture to avoid the situation that one of the light bulbs is darker than others or even fails to illuminate. Therefore, the lighting artistry of the whole lighting fixture can be maintained, and the total consumed power of all the light bulbs in the light bulb module is capable of meeting the requirement of the maximum rated power consumption of the illumination equipment under the local ordinance.

1 Claim, 1 Drawing Sheet

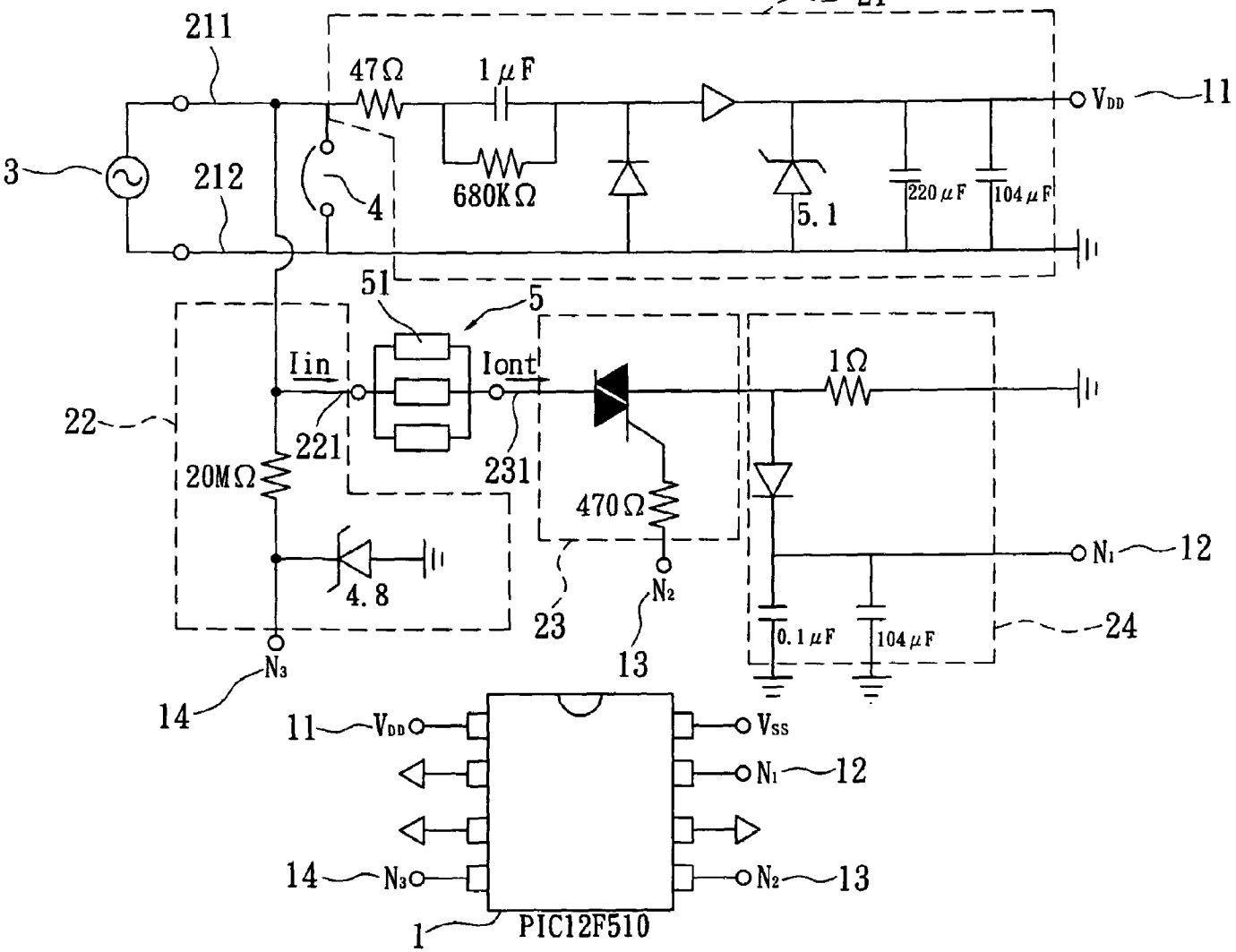
11
$V_{DD}$
104μF
220μF
21
5.1
1μF
680KΩ
47Ω
4
211
212
3
5
51
Iont
231
Iin
221
20MΩ
22
1Ω
470Ω
23
$N_2$
13
$N_1$
12
24
104μF
0.1μF
4.8
$N_3$
14
$V_{SS}$
PIC12F510
1

BRIGHTNESS CONTROL DEVICE OF LIGHT BULB MODULE

BACKGROUND OF THE INVENTION

1. Field of the Invention

The present invention relates to a brightness control device for controlling a light bulb module, and more particularly to a brightness control device for controlling a light bulb module to keep an even luminance of each of the light bulbs thereof, while the total consumed electric power of the light bulb module is below the maximum rated power consumption of the illumination equipment to meet the local energy ordinance.

2. Description of Related Art

In the recent years, the global energy crisis is getting more serious. Accordingly, many countries have issued various energy saving bills for dealing with such a situation. For example, the government of California in the United States is asking a strict restriction on electricity usage to the departments of the government, the enterprises, and the residents. Even more, alternating power supply in divided areas is enforced by the government due to power shortage. Currently, the United States also regulates in the law of energy the maximum rated power consumption of the related indoor illumination equipments. Each of the illumination equipments sold on the market is also required to be mounted thereon a rated power circuit breaker before leaving the factory. The rated power circuit breaker will cut out the electricity when the maximum rated power consumption is exceeded to ensure that the consumed power level of the illumination equipment meets the restrict requirement from the government. For example, according to the regulation of US energy policy, the maximum rated power consumption for the light bulb module of a normal home ceiling fixture is 190 watt. In the situation that four 50-watt light bulbs are mounted within a light bulb module of the lighting fixture, the total electric power consumption will exceed the 190-watt restrict value and thus the rated power circuit breaker set with a 190-watt normal rated power will be activated. Accordingly, the light bulb module of the lighting fixture cannot illuminate unless one of the four bulbs is removed or replaced by another light bulb consuming less electric power to meet the requirement. However, both the two methods may cause either inconvenience to the users or uneven luminance of the lighting fixture which will deeply deteriorate the lighting artistry of the entire lighting fixture.

Therefore, to control the light bulb module to illuminate evenly while meet the requirements of the energy policy in every country, a need exits for a circuitry designed for achieving foresaid objects.

SUMMARY OF THE INVENTION

A primary object of the present invention is to provide a brightness control device of a light bulb module for solving the above-mentioned problems. A brightness control device is provided for controlling a light bulb module to keep an even luminance of each of the light bulbs and to keep each of the light bulbs from being darker than others or even failing to illuminate. Therefore, the lighting artistry of the whole lighting fixture is maintained, and the total consumed power of all the light bulbs in the light bulb module of a illumination equipment is less than the maximum rated power consumption ruled under the local ordinance.

For achieving the above-mentioned objects, the control device of the present invention includes: a microcontroller having a power supply pin, a first pin, a second pin, and a third pin;

a first control circuit having a plurality of resistors, a plurality of inductors, a diode, an amplifier, and a zener diode, wherein the first control circuit includes two power input terminals electrically connected to a Public AC Power; an rated power circuit breaker is connected in parallel between the two power input terminals; and the first control circuit is electrically connected to the power supply pin of the microcontroller;

a second control circuit equipped with a resistor and a zener diode and is electrically connected to the third pin of the microcontroller wherein the second control circuit includes a current input terminal, which is electrically connected to a light bulb module having several light bulbs connected in parallel and is also electrically connected between one of the two power input terminals of the first control circuit and the rated power circuit breaker;

a third control circuit equipped with an alternating current thyristor and a resistor, which is further equipped with a current output terminal electrically connected to the light bulb module, wherein the third control circuit is electrically connected to the second pin of the microcontroller and is also electrically connected to the fourth control circuit;

a fourth control circuit equipped with a resistor, a plurality of inductors, and a diode, wherein a terminal of the fourth control circuit is electrically connected to the third control circuit, and the other terminal of the fourth control circuit is electrically connected to the first pin of the microcontroller.

BRIEF DESCRIPTIONS OF DRAWINGS

The FIGURE is a circuit diagram schematically illustrating the control device according to an embodiment of the present invention applied in a light bulb module having several light bulbs.

DETAILED DESCRIPTIONS OF THE INVENTION

The FIGURE illustrates an embodiment of the present invention. It is to be understood that the embodiment described here is just to help those skilled in the art to understand the content of the invention, and the invention needs not be limited to the disclosed circuit structures.

The embodiment relates to a brightness control device adapted to be used with a light bulb module, which includes a microcontroller. In this embodiment, the microcontroller 1 is PIC12F510 microcontroller produced by Microchip. The microcontroller 1 includes a power supply pin 11, a first pin 12, a second pin 13, and a third pin 14. Except for the four used pins, the other pins of the microcontroller 1 are floating.

The brightness control device further includes a first control circuit 21. The first control circuit 21 includes a plurality of resistors, a plurality of inductors, a diode, an amplifier, and a zener diode. The first control circuit 21 includes two power input terminals 211 and 212 for being electrically connected to a Public AC Power 3. A rated power circuit breaker 4 is connected in parallel between the two power input terminals 211 and 212. The first control circuit 21 is electrically connected to a power supply pin 11 of the microcontroller 1.

The brightness control device further includes a second control circuit 22. The second control circuit 22 is equipped with a resistors and a zener diode. The second control circuit 22 is electrically connected to a third pin 14 of the microcontroller 1. The second control circuit 22 further includes a current input terminal 221. The current input terminal 221 is electrically connected to a light bulb module 5 having several light bulbs 51 connected to each other in parallel. The current input terminal 221 is also electrically connected between one of the two power input terminals 211 of the first control circuit 21 and the rated power circuit breaker 4.

The brightness control device further includes a third control circuit 23. The third control circuit 23 is equipped with an alternating current thyristor and a resistor. The third control circuit 23 further includes a current output terminal 231. The current output terminal 231 is electrically connected to a light bulb module 5. The third control circuit 23 is electrically connected to a second pin 13 of the microcontroller 1.

The brightness control device further includes a fourth control circuit 24. The fourth control circuit 24 is equipped with a resistor, a plurality of inductors, and a diode. A terminal of the fourth control circuit 24 is electrically connected to the third control circuit 23, and the other terminal of the fourth control circuit 24 is electrically connected to the first pin 12 of the microcontroller 1.

As shown in FIG. 1, the present invention is implemented on a lighting fixture that has a light bulb module 5 constructed by three light bulbs 51 connected in parallel. Each of the three light bulbs 51 is labeled "70 watt". Meanwhile, the maximum rated power consumption restricted by the local ordinance is 190 watt, while the Public AC Power is 220 volt. Thereupon, a user can mount the control device of the present invention on this lighting fixture. By means of the setting and control of the microcontroller 1 in cooperated with the matching design of the four control circuits 21, 22, 23, and 24, the electric power between the current input terminal 221 of the second control circuit 22 and the current output terminal 231 of the third control circuit 23 can be kept below the restrict electric power 190 watt so as to prevent rated power circuit breaker 4 which is set with a 190-watt protective threshold from breaking circuit and shutting the light bulbs 51. Thus, all the light bulbs 51 of the light bulb module 5 can light up with even luminance. That is, all the light bulbs 51 light in a uniform electric power of 63 watts. Therefore, the lighting fixture can not only meet the illumination requirement, but also maintain the artistry of the illumination of the whole lighting fixture. Furthermore, no extra designing modification is needed to meet the requirement of the maximum rated power consumption of the illumination equipment, and thus the manufacturing cost is reduced.

It is known from the descriptions of the above-mentioned embodiments that, the advantage of the present invention is that the light bulbs of the light bulb module can be kept in an even luminance under the control of the control device according to the present invention, and the situation that one of the light bulbs which is darker than others or even fails to illuminate is avoided. Therefore, the lighting artistry of the whole lighting fixture is maintained, and the total consumed power of all the light bulbs in the light bulb module is capable of meeting the requirement of the maximum rated power consumption of the illumination equipment under the local ordinance.

What is claimed is:

1. A brightness control device adapted to be used with a light bulb module, comprising:

a microcontroller having a power supply pin, a first pin, a second pin, and a third pin;

a first control circuit having a plurality of resistors, a plurality of inductors, a diode, an amplifier, and a zener diode, wherein said first control circuit includes two power input terminals electrically connected to a Public AC Power; a rated power circuit breaker is connected in parallel between said two power input terminals; and said first control circuit is electrically connected to said power supply pin of said microcontroller;

a second control circuit equipped with a resistor and a zener diode, wherein said second control circuit is electrically connected to said third pin of said microcontroller, and further includes a current input terminal which is electrically connected to a light bulb module having several light bulbs connected in parallel wherein said current input terminal is also electrically connected between one of said two power input terminals of said first control circuit and said rated power circuit breaker;

a third control circuit equipped with an alternating current thyristor, a resistance, and a current output terminal, wherein said current output terminal is electrically connected to said light bulb module, and said third control circuit is electrically connected to said second pin of said microcontroller;

a fourth control circuit equipped with a resistor, a plurality of inductors, and a diode, wherein said fourth control circuit includes an terminal electrically to said third control circuit, and said fourth control circuit further includes another terminal electrically connected to said first pin of said microcontroller.

* * * * *

US007301290C1

(12) INTER PARTES REEXAMINATION CERTIFICATE (0138th)

United States Patent
Tseng

(10) Number: US 7,301,290 C1
(45) Certificate Issued: Jan. 12, 2010

(54) BRIGHTNESS CONTROL DEVICE OF LIGHT BULB MODULE

(76) Inventor: Ming-Chi Tseng, No. 18, Jhensing E. St., Wufong Township, Taichung County 413 (TW)

Reexamination Request:
No. 95/001,041, Apr. 29, 2008

Reexamination Certificate for:

| | |
|---|---|
| Patent No.: | **7,301,290** |
| Issued: | **Nov. 27, 2007** |
| Appl. No.: | **11/709,656** |
| Filed: | **Feb. 23, 2007** |

(51) Int. Cl.
*H05B 37/02* (2006.01)

(52) U.S. Cl. ..... 315/299; 315/307

(58) Field of Classification Search ..... None

See application file for complete search history.

(56) References Cited

U.S. PATENT DOCUMENTS

| | | | | |
|---|---|---|---|---|
| 4,675,777 | A | 6/1987 | Watrous | 361/106 |
| 5,909,090 | A | 6/1999 | Nakamura et al. | 315/307 |

FOREIGN PATENT DOCUMENTS

| | | | |
|---|---|---|---|
| GB | 2349959 | A | 11/2000 |

*Primary Examiner*—Linh M. Nguyen

(57) ABSTRACT

A brightness control device for a light bulb module utilizes a microcontroller equipped with a first control circuit, a second control circuit, a third control circuit, and a fourth control circuit to maintain an even luminance of each light bulb in the light bulb module of a lighting fixture to avoid the situation that one of the light bulbs is darker than others or even fails to illuminate. Therefore, the lighting artistry of the whole lighting fixture can be maintained, and the total consumed power of all the light bulbs in the light bulb module is capable of meeting the requirement of the maximum rated power consumption of the illumination equipment under the local ordinance.

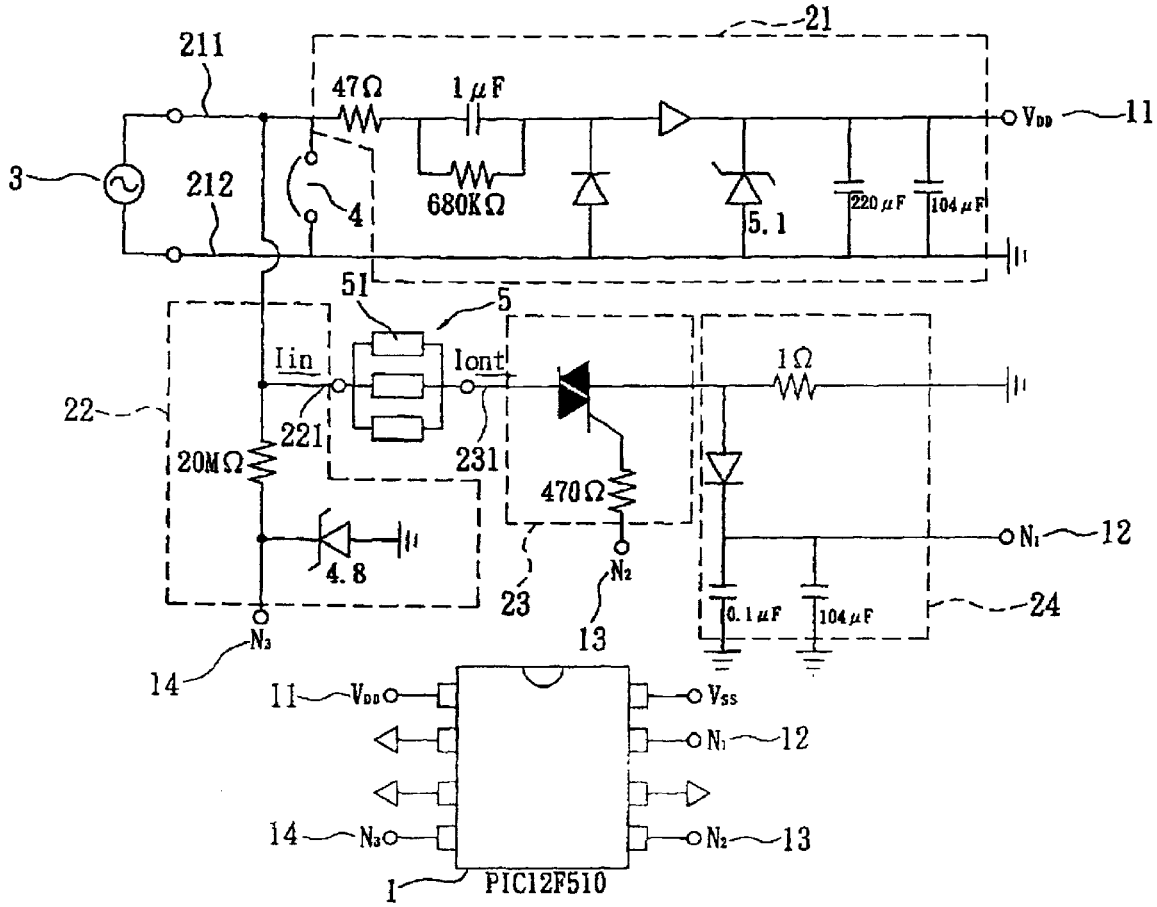

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *